US008063334B2

(12) United States Patent
Dahl

(10) Patent No.: US 8,063,334 B2
(45) Date of Patent: Nov. 22, 2011

(54) SWITCHING DEVICE, IN PARTICULAR POWER SWITCHING DEVICE

(75) Inventor: Jörg-Uwe Dahl, Werder (DE)

(73) Assignee: Siemens Aktiengesellschaft, Munich (DE)

( * ) Notice: Subject to any disclaimer, the term of this patent is extended or adjusted under 35 U.S.C. 154(b) by 486 days.

(21) Appl. No.: 12/319,000

(22) Filed: Jan. 14, 2009

(65) Prior Publication Data

US 2009/0194510 A1 Aug. 6, 2009

(30) Foreign Application Priority Data

Jan. 16, 2008 (DE) ..... 10 2008 005 101

(51) Int. Cl.
*H01H 33/98* (2006.01)

(52) U.S. Cl. ..... 218/114; 218/52; 218/76; 218/86

(58) Field of Classification Search ..... 218/52, 218/76, 86, 114
See application file for complete search history.

(56) References Cited

U.S. PATENT DOCUMENTS

| | | | | |
|---|---|---|---|---|
| 3,631,369 | A | 12/1971 | Menocal | |
| 4,027,125 | A * | 5/1977 | Peek et al. | 218/44 |
| 4,206,331 | A * | 6/1980 | Kii | 218/47 |
| 4,276,526 | A | 6/1981 | Ciarcia | |
| 5,103,198 | A | 4/1992 | Morel et al. | |
| 6,163,001 | A * | 12/2000 | Zehnder et al. | 218/11 |
| 6,573,815 | B1 * | 6/2003 | Tsukima et al. | 335/202 |
| 7,497,122 | B2 * | 3/2009 | Montesclaros et al. | 73/700 |

FOREIGN PATENT DOCUMENTS

| | | | |
|---|---|---|---|
| DE | 69110540 | T2 | 2/1996 |
| DE | 19601639 | A1 | 7/1997 |
| DE | 19908575 | A1 | 8/2000 |
| DE | 10342131 | A1 | 4/2004 |
| EP | 0455564 | B1 | 11/1991 |

* cited by examiner

*Primary Examiner* — Truc Nguyen
(74) *Attorney, Agent, or Firm* — Harness, Dickey & Pierce, P.L.C.

(57) ABSTRACT

The switching device of at least one embodiment includes at least two switching contacts for interruption of a current path, with the switching contacts being arranged in a quenching chamber in order to quench an arc which is struck on opening. The quenching chamber opens into a gas outlet channel for overpressure which is produced during the striking of the arc to escape from. A pressure sensor for pressure detection is provided in the gas outlet channel and trips a switching mechanism, which is at least indirectly connected thereto, of the switching device on reaching a predeterminable pressure value. According to at least one embodiment of the invention, the gas outlet channel includes a Venturi nozzle. A reduced pressure, which is created in the Venturi nozzle as the gas flow passes through, is detectable by way of the pressure sensor.

16 Claims, 3 Drawing Sheets

SWITCHING DEVICE, IN PARTICULAR POWER SWITCHING DEVICE

PRIORITY STATEMENT

The present application hereby claims priority under 35 U.S.C. §119 on German patent application number DE 10 2008 005 101.2 filed Jan. 16, 2008, the entire contents of which is hereby incorporated herein by reference.

FIELD

Embodiments of the invention generally relate to a switching device, in particular a power switching device, having at least two switching contacts for interruption of a current path. In at least one embodiment, the switching contacts are arranged in a quenching chamber in order to quench an arc which is struck on opening. The quenching chamber opens into a gas outlet channel for overpressure which is produced during the striking of the arc to escape from. A pressure sensor for pressure detection is provided in the gas outlet channel, which pressure sensor trips a switching mechanism, which is connected at least indirectly thereto, of the switching device on reaching a predeterminable pressure value.

In at least one embodiment, the invention relates in particular to electrical switching devices, in particular to power switching devices, in the low-voltage range, that is to say up to voltages of about 1000 Volts.

BACKGROUND

Switching devices are designed in particular to interrupt current paths in the event of a short circuit or in the event of an overcurrent. Furthermore, the switching devices may be designed with one or more poles, in particular with three poles. They can have one or more switching contact pairs for each pole. In particular, the switching devices are designed to disconnect currents of more than 100 A, in particular of several thousand A.

A release for a circuit breaker with a dielectric housing which comprises two contacts, which are pressed against one another in a sprung manner when the circuit breaker is in the connected position, per pole is disclosed in the German translation DE 691 10 540 T2 or European patent specification EP 0 455 564 B1, the entire contents of each of which is hereby incorporated herein by reference. The contacts can be separated by the effect of electrodynamic repulsion forces when the current flowing through the contacts exceeds a specific threshold value, in order in this way to limit the current. The release comprises an overload and/or short-circuit detection element in order to act on a switching mechanism which automatically disconnects the circuit breaker in the event of a fault.

Furthermore, the release comprises an operating member which responds to an overpressure which is produced in the separation zone of the contacts by an arc that is struck on electrodynamic repulsion of the contacts, in order to operate the disconnection mechanism of the circuit breaker. The operating member is a gas-tight unit which is connected exclusively to the separation zone of the contacts and comprises a moving element such as a piston or a membrane with a limited control travel. The moving element first has the overpressure applied to it, and secondly a return apparatus with a matched active force. Its movement results in tripping of the disconnection mechanism of the circuit breaker, with the return apparatus being designed with a matched active force so as to prevent inadvertent tripping in the event of a simple overload or response of a downstream current-limiting circuit breaker.

U.S. Pat. No. 3,631,369 A discloses a release with a moving armature. The armature is in the form of a bimetallic strip, and the electromagnetic release can act on it. An extension from the armature projects into the gas outlet channel of the arc quenching chamber. During disconnection, the armature is moved by the gas flow to the tripping position.

The power switching devices under consideration are, for example, so-called MCCB switching devices (Molded-Case Circuit Breakers). In the case of a switching device such as this, the current to be interrupted is interrupted before it reaches its maximum value, in that the switching contacts of the MCCB are drawn apart from one another by electromagnetic repulsion of adjacent conductors, thus interrupting the current.

Alternatively or additionally, the switching contacts may be operated, for example, by way of an actuator, which can preferably be operated electromagnetically. The actuator may be operated, for example, by an overload and/or short-circuit detection element.

A splitter stack for cooling the hot arc plasma during opening of the switching contacts is typically provided in the area of the switching contacts. Cooling the plasma down decreases the electrical conductivity such that the voltage required to maintain the arc is no longer sufficient. The arc breaks down and the current is interrupted.

In the case of the switching device mentioned initially according to EP 0 455 564 B1, the switching mechanism can be tripped not only by the overload and/or short-circuit detection element but also by a pressure-dependent operating member which acts independently thereof. The overpressure created when the arc is struck is used as a tripping criterion, and this is directly related to the arc energy. In other words, the pressure increases to a greater extent, the higher the arc energy is. Energy-selective disconnection of the switching device is therefore possible by evaluation of the overpressure.

SUMMARY

In at least one embodiment of the invention specifies an alternative switching device and/or a switching device which trips more reliably.

According to at least one embodiment of the invention, the gas outlet channel has a Venturi nozzle. A reduced pressure, which is created in the Venturi nozzle as the gas flow passes through, can be detected by way of the pressure sensor.

When the exhaust gas flow which is created when the arc is struck flows through a Venturi nozzle such as this, the dynamic pressure, that is to say the ram pressure, at the narrowest point in the gas outlet channel is a maximum, and the static pressure, that is to say the rest pressure, is a minimum. In this case, the speed of the gas flow rises in the same ratio as the channel cross sections on flowing through the constricted part. At the same time, the pressure falls as the constriction increases. If the reduced pressure falls below a predetermined pressure value with respect to the environmental pressure, for example of 0.8 bar, then the pressure sensor trips the switching mechanism.

One advantage over switching mechanism tripping based on overpressure is that no contaminated exhaust gas parts are forced into the pressure sensor by the overpressure, which has no effect in the Venturi nozzle. In fact, the "suction" reduced pressure keeps the pressure sensor free of contamination.

According to one embodiment, the gas outlet channel is in the form of a tube or shaft. The gas outlet channel has a constriction in order to produce the reduced pressure. The constriction is preferably formed by the gas outlet channel itself. By way of example, the constriction may be introduced into the material of the gas outlet channel by way of a shaping tool. Possible materials include, for example, temperature-resistant plastics, such as polyamide, or laminated channels or tubes. A bore or an opening, to which the pressure sensor can be provided, is typically provided at the point of maximum constriction, that is to say at the point where the shaft or tube has its smallest cross section.

According to a further embodiment, the pressure sensor is connected to the Venturi nozzle via a pressure connection line in order to detect the reduced pressure. Flexible tubes or pipelines, in particular, may be used as pressure connection lines. This is associated with the particular advantage that the pressure sensor can be arranged at a point in the switching device which is advantageous from the design point of view. The pressure sensor has a corresponding inlet to which the pressure connection line can be connected. The other end of the pressure connection line is then connected to the bore or to the opening at the point with the maximum constriction in the gas outlet channel.

In a further embodiment, the pressure connection line has a connecting piece for connection to the Venturi nozzle. The connecting piece has a pressure equalizing element for at least virtually gas-tight connection of the Venturi nozzle to the pressure sensor. By way of example, the connecting piece may be cylindrical. It is designed in a suitable manner for fitting to the gas outlet channel. The pressure equalizing element in the connecting piece prevents even very small pieces of dirt being able to pass from the gas outlet channel into the pressure sensor or via the pressure connection line into the pressure sensor. The pressure equalizing element is designed such that approximately the same pressure is created on both sides of the pressure equalizing element. The pressure equalizing element is typically a membrane, for example a metal membrane, or a piston which can move within the cylinder of the connecting piece. This allows the reduced pressure to be passed on in an at least virtually gas-tight manner via the pressure connection line to the pressure sensor.

According to one particularly advantageous embodiment, an incident-flow element is arranged in the gas outlet channel and divides the gas outlet channel into a measurement flow channel and a main flow channel. The measurement flow channel is provided for pressure detection by way of the pressure sensor. The subdivision makes it possible for a reduced pressure that is sufficient for measurements to be produced only in a small channel cross section of the gas outlet channel. The majority of the gas flow can then escape virtually without any impediment, in the sense of a bypass, through the gas outlet channel from the switching device.

The incident-flow element may be a separate component which is introduced into the gas outlet channel. It may be part of a piece of piping which is introduced into the gas outlet channel in the sense of a measurement tube. In this case, the measurement tube may have a considerably smaller cross section than the gas outlet channel.

In a further embodiment, the pressure sensor is itself in the form of an at least approximately gas-tight unit. The pressure sensor preferably has a cylinder and a piston which is arranged such that it can move therein and has an operating slide in order to trip the switching mechanism. The piston in this case divides the cylinder into two pressure areas, with the first pressure area being connected directly to the environmental air, that is to say to the environmental pressure of the switching device. In the simplest case, the cylinder has a continuous opening to the "exterior". Alternatively, a further pressure connection line can be connected to this point of the cylinder, whose other end is connected to an unconstricted point, by way of the quenching chamber or the gas outlet channel.

In a further embodiment, the pressure sensor is connected as a pressure-dependent operating element in order to trip a tripping mechanism of the switching mechanism. The tripping mechanism preferably has a spring energy store which can be prestressed, for example manually. When tripping occurs, the operating slide of the pressure sensor can unlatch the spring energy store, as a result of which the latter can move the switching mechanism to the open position. Alternatively, the pressure sensor may be an electrical or electronic component which, for example, provides an electrical sensor signal, which corresponds to the reduced pressure, by way of a piezo-sensor. Furthermore, the pressure sensor may have an electronic evaluation unit for production of a switching signal when the electrical sensor signal reaches a predetermined threshold value. The electrical switching signal can be used to operate an electromagnetic operating element, which acts on the tripping mechanism or directly on the switching mechanism, in order to open the switching contacts.

According to a further embodiment, the switching device has a plurality of poles. In particular, the switching device has three poles. One quenching chamber, one gas outlet channel and one pressure sensor are provided for each pole. The respective pressure sensor is connected to a tripping mechanism in order to trip the switching mechanism. This advantageously allows the switching device to be tripped pole-by-pole.

According to one example embodiment, the respective pressure sensors are connected to a joint common shaft of the tripping mechanism. This allows all the poles of the switching device to be disconnected.

According to one alternative embodiment, the switching device has a plurality of poles. One quenching chamber and one gas outlet channel are provided for each pole. The respective gas outlet channels open into a joint gas outlet common channel. The pressure sensor is connected to the gas outlet common channel for pressure detection, and is connected to a tripping mechanism in order to trip the switching mechanism. The particular advantage of this embodiment is that only one pressure sensor, that is to say only a single pressure sensor, is required for pressure detection instead of three pressure sensors.

According to one embodiment, the gas outlet channels are each connected to the joint gas outlet common channel via a reverse-flow flap. This effectively prevents any gas flow from one pole to another pole.

According to a further alternative embodiment, the switching device has a plurality of poles. All the switching contacts, in particular all the power switching contacts, are arranged in a common quenching chamber. The respective switching contacts of one pole are electrically isolated from one another. The common quenching chamber opens into the gas outlet channel. The pressure sensor is connected to a tripping mechanism in order to trip the switching mechanism.

The use of a common quenching chamber simplifies the design of a switching device according to at least one embodiment of the invention. Electrically insulating separating walls or partitions are preferably introduced between the respective poles. In particular, the quenching chamber elements open into the common quenching chamber such that any flow reaction of one of the quenching chamber elements on the other quenching chamber elements is largely prevented.

According to a further embodiment of the invention, the switching device has at least two switching contacts, which are pressed against one another in a sprung manner when the switching device is in the connected position, for each pole. The switching contacts can be separated by the effect of electromagnetic repulsion forces when a current which is flowing through the switching contacts exceeds a specific threshold value for current limiting. The switching device has an overload and/or short-circuit detection element in order to trip the switching mechanism.

In this embodiment of the switching device, two mutually independent tripping mechanisms act in order to trip the switching mechanism. The first tripping mechanism is based on current detection in the respective current path. The second tripping mechanism is based on pressure evaluation of a respective overpressure produced by the arc. The switching contacts are held closed by way of a contact spring. Fixed contacts, which are typically bent in a U shape, when current is being supplied to the switching contacts mean that the switching contacts are lifted off briefly in the event of an overcurrent, in particular in the event of a short circuit, in order to limit the overcurrent or short-circuit current, forming an arc. If the overcurrent or short-circuit situation lasts for only a short time and this current does not reach a predetermined threshold value, then the switching contacts close again. A switching device such as this therefore has a staggered, that is to say selective, disconnection behavior.

BRIEF DESCRIPTION OF THE DRAWINGS

The invention as well as advantageous embodiments of the invention will be described in the following text with reference to the following figures, in which.

DETAILED DESCRIPTION OF THE EXAMPLE EMBODIMENTS

Figure 1:
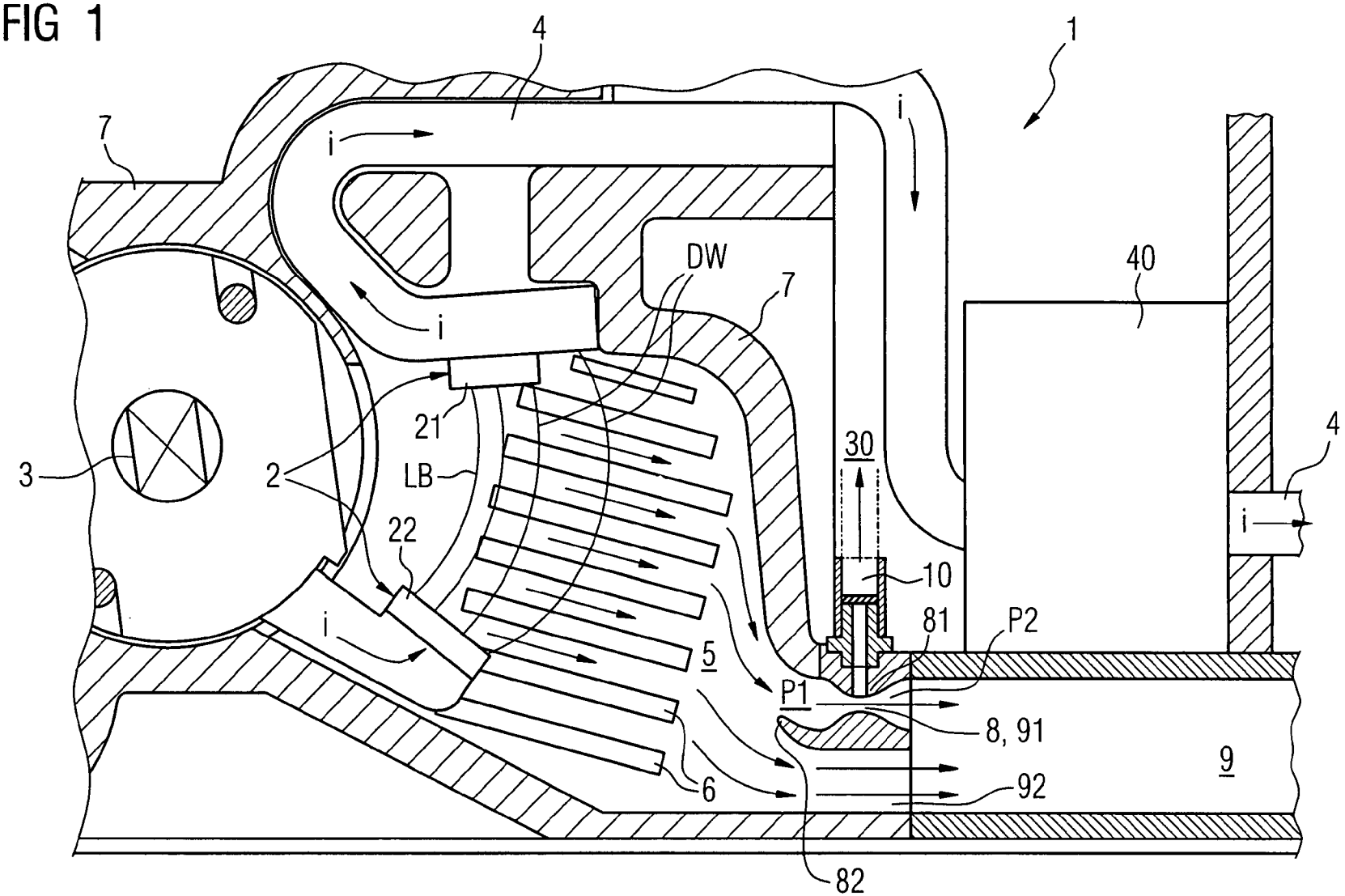
FIG. 1 shows a detail of a switching device with an example of a Venturi nozzle according to an embodiment of the invention.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe-various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a detail of a switching device 1 with an example of a Venturi nozzle 8 according to an embodiment of the invention.

The left-hand part of FIG. 1 shows a switching shaft 3 in order to open and close two switching contacts 21, 22. The two illustrated switching contacts 21, 22 form a switching contact pair 2. Alternatively, and not illustrated in FIG. 1, the switching shaft 3 can be designed to open and close two or more switching contact pairs 2. In this case, the switching shaft 3 is connected to a multiple contact. The switching contacts 21, 22 are arranged in a quenching chamber, which is annotated with the reference symbol 5, in order to quench an arc LB which has been struck during opening. The quenching chamber 5 is preferably formed by a housing 7 of the switching device 1. The housing 7 is typically composed of a dielectric, for example a plastic. The reference symbol i denotes a current flowing through a current path 4 to be interrupted. The current path 4 leaves the switching device 1 in the right-hand part of FIG. 2, to an electrical connection which is not illustrated in any more detail. Furthermore, the illustrated current path 4 is passed through a current transformer as an overload and/or short-circuit detection element 40. An electrical switching signal derived from the current transformer 40 can then be used to trip a switching mechanism, which is not illustrated in any more detail in FIG. 1, when a current threshold value is reached.

A splitter stack 6 is also arranged in the area of the open contacts 21, 22 and has a multiplicity of quenching plates in order to cool the arc plasma. The quenching chamber 5 opens into a gas outlet channel 9, which is in the form of a tube or shaft, for an overpressure P1 which is produced when the arc LB is struck to escape. The reference symbol DW denotes a pressure wave which passes through the quenching plates of the splitter stack 6 when the arc LB is struck, and then runs further into the gas outlet channel 9.

According to an embodiment of the invention, the gas outlet channel 9 has a Venturi nozzle 8, in which case a reduced pressure P2, which is created in the Venturi nozzle 8 when the gas flows through it, can be detected by way of a pressure sensor 10. In the example in FIG. 1, the pressure sensor 10 is fitted in the mouth area of the gas outlet channel 9. The gas outlet channel 9 furthermore has a constriction 81 in order to produce the reduced pressure P2. The reduced pressure is tapped off for measurement purposes by the pressure sensor 10 in the area of the narrowest point, that is to say the maximum constriction. In the simplest case, a measurement opening, which is not denoted in any more detail, of the pressure sensor 10 projects into the narrowed point 81 of the Venturi nozzle 8. When the reduced pressure P2 now reaches a predetermined threshold value, then the pressure sensor 10 can at least indirectly trip a switching mechanism 30, which is connected thereto, by mechanical or electrical device(s).

Furthermore, an incident-flow element 82 is arranged in the illustrated gas outlet channel 9 and divides the gas outlet channel 9 into a measurement flow channel 91 and a main flow channel 92. The measurement flow channel 91 is in this case provided for pressure detection according to the invention by way of the pressure sensor 10. FIG. 1 also shows that a large proportion of the gas flow, as indicated by arrows, passes through the gas outlet channel 9, in the sense of a bypass.

Figure 2:
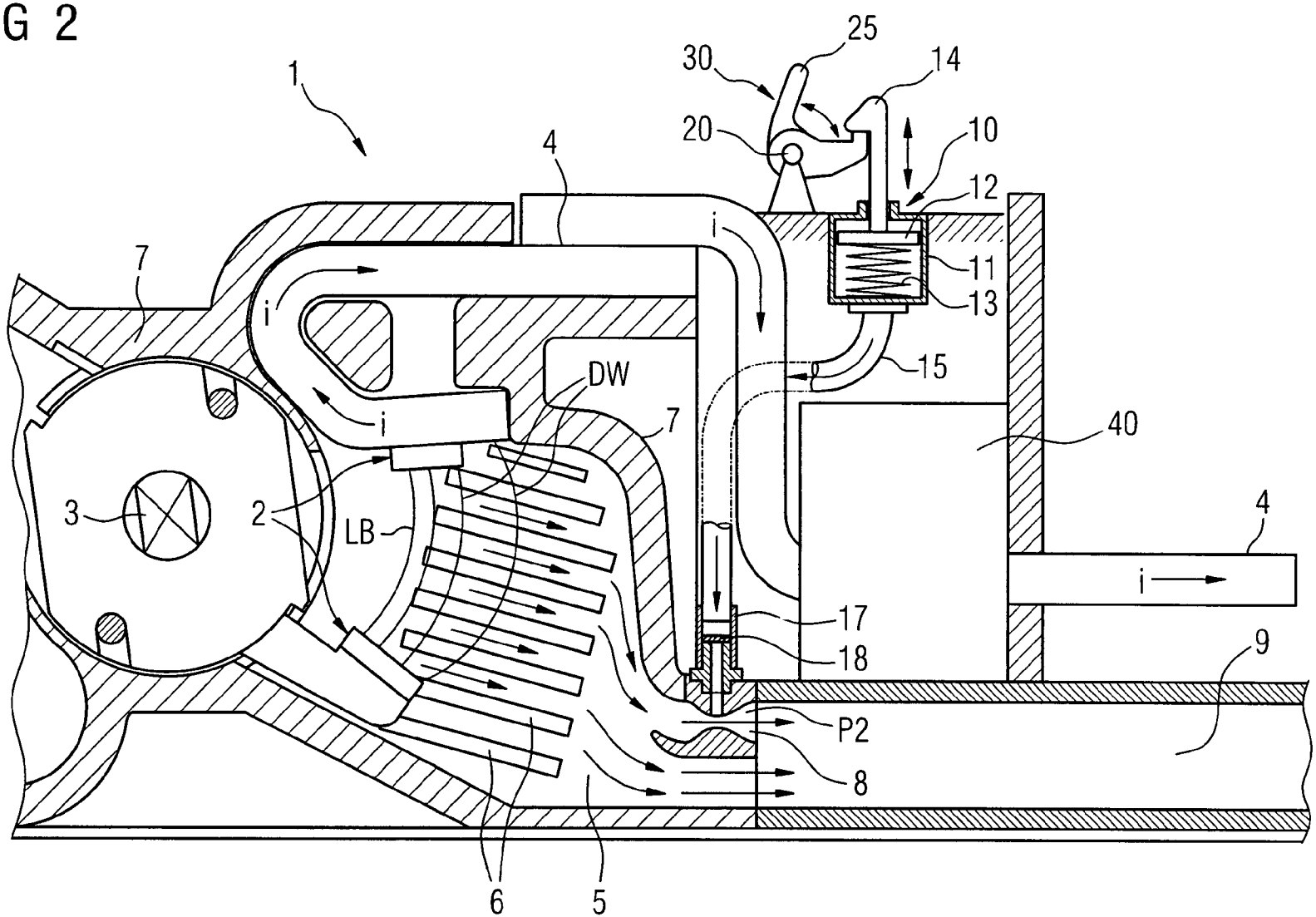
FIG. 2 shows a first embodiment of the switching device.

FIG. 2 shows a first embodiment of the switching device 1. In this embodiment, the pressure sensor 10 is connected via a pressure connection line 15 to the Venturi nozzle 8 in order to detect the reduced pressure P2. The pressure connection line 15 has a connecting piece 17 which is provided for connection to the Venturi nozzle 8. The connecting piece 17 also has a pressure equalizing element 18, preferably a membrane, for gas-tight connection of the Venturi nozzle 8 to the pressure sensor 10. The pressure sensor 10 is preferably arranged in the area of the switching mechanism 30 of the switching device 1. In the present example, the pressure sensor 10, which is in the form of a pressure-dependent operating element, acts on a tripping mechanism 25 in order to trip the switching mechanism 30. For this purpose, an operating slide 14 of the operating element 10 engages, with its end that is in the form of a catch, in a tripping lever, which is not shown in any more detail, of the tripping mechanism 25. The operating slide 14 is connected to a piston 12 which is guided such that it can move, and is at least approximately gas-tight, in a cylinder 11 of the pressure sensor 10. The reduced pressure P2 created in the Venturi nozzle 8 now acts directly via the pressure connection line 15 on the piston 12 of the pressure-dependent operating element 10. A movement of the piston 12 and of the operating slide 14 caused by this leads to tripping of the tripping mechanism 25, once a predetermined pressure threshold value has been reached.

By way of example, the switching device 1 shown in FIG. 2 has a plurality of poles, although only one pole can be seen in the present illustration. A switching device 1 such as this has one quenching chamber 5, one gas outlet channel 9 and in each case one pressure sensor 10 for each pole. The respective pressure sensor 10 is connected to a tripping mechanism 25 in order to trip the switching mechanism 1 or, as already illustrated in FIG. 2, is connected to a joint common shaft 20 of the tripping mechanism 25.

Figure 3:
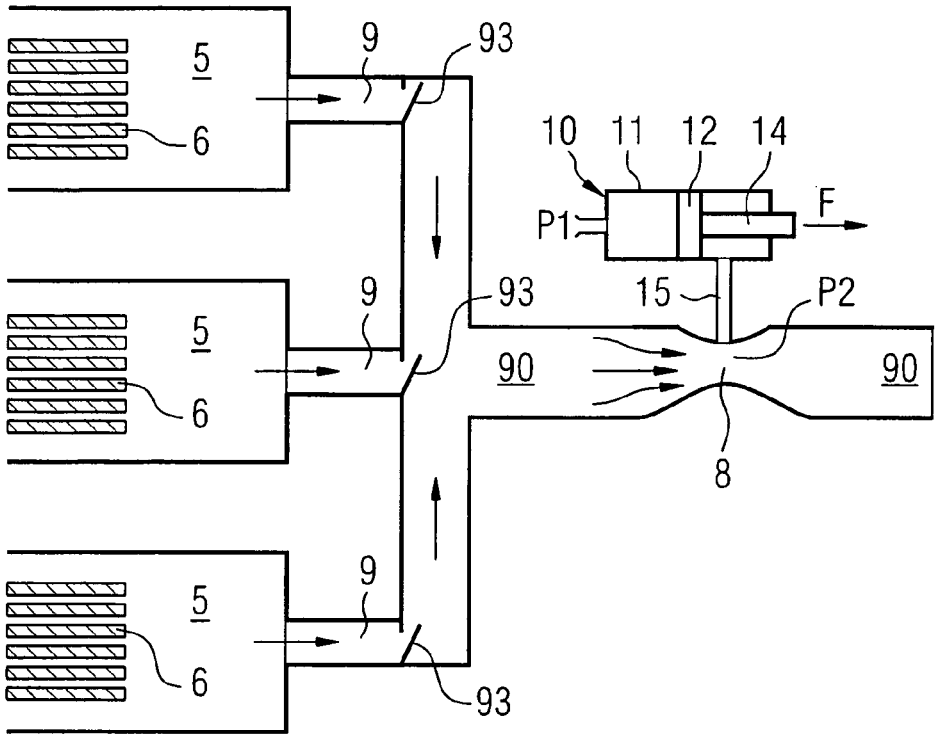
FIG. 3 shows a second embodiment of the switching device in an example three-pole version.

FIG. 3 shows a second embodiment of the switching device 1 in an example of a three-pole embodiment. In this embodiment, one quenching chamber 5 and one gas outlet channel 9 are provided for each pole. The respective gas outlet channels 9 open into a joint gas outlet common channel 90 in which there is once again a pressure sensor 10 for pressure detection of the reduced pressure P2 in the Venturi nozzle 8. In this case, it is advantageous that only one (a single) pressure sensor is required for joint tripping of the switching mechanism on reaching a minimum arc power.

In the example illustrated in FIG. 3, the pressure sensor 10 is in the form of a pressure-dependent operating element with a cylinder 11 and a piston 12. The operating slide 14 is connected to the piston 12 in order to apply a tripping force F. The left-hand pressure area of the illustrated pressure sensor 10 has an opening to the environmental pressure P1. When a reduced pressure P2 is applied, that is to say when there is a pressure difference P2-P1, the illustrated piston 12 is moved in the tripping direction, to the right.

Furthermore, the three illustrated gas outlet channels 9 are each connected via a reverse-flow flap 93 to the joint gas outlet common channel 90. This prevents gas from flowing back from one of the illustrated quenching chambers 5 into the respective other quenching chambers 5. This is advantageous, for example, when the switching device 1 is intended for three-pole disconnection of a three-phase current, and a high arc power is reached in one or in two of the three quenching chambers 5. The gas flow that is created flows virtually without being braked with the aid of the reverse-flow flaps 93, and with its entire volume, through the gas outlet common channel 90.

Figure 4:
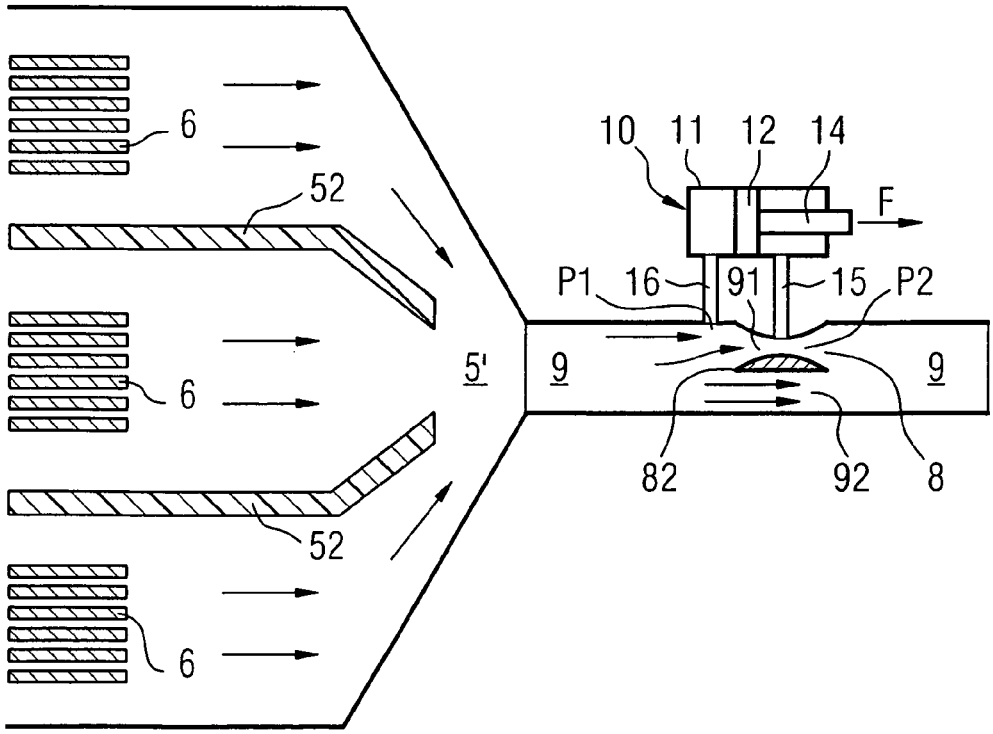
FIG. 4 shows a third embodiment of the switching device.

FIG. 4 shows a third embodiment of the switching device 1. In this example, all the switching contacts 21, 22 are arranged in a common quenching chamber 51. The respective switching contacts 21, 22 are in this case isolated from one another, pole-by-pole. This is achieved in the example shown in FIG. 4 by way of electrically non-conductive separating walls 52. The common quenching chamber 5 and the separating walls 52 are designed from the flow point of view such that they extend towards the gas outlet channel 9, and in the process taper. From the flow point of view, this largely prevents a gas flow which emerges from one quenching chamber element 5 from flowing into the other quenching chamber elements 5. In other words, all the gas flows preferably run, in the sense of a nozzle, into the mouth area of the gas outlet channel 9. In the right-hand part of FIG. 4, the gas outlet channel 9 is subdivided by way of an incident-flow aid 82 into a measurement flow channel 91 and a main flow channel 92. In the example shown in FIG. 4, the pressure-dependent operating element 10 is connected via two pressure connection lines 15, 16 to the unconstricted area of the gas outlet channel 9 in order to detect the overpressure P1, and is connected to the constricted area of the Venturi nozzle 8 in order to detect the reduced pressure P2.

Furthermore, according to an embodiment of the invention, the switching device 1 has at least two switching contacts 21, 22, which are pressed against one another in a sprung manner when the switching device 1 is in the connected position, for each pole. So-called contact springs are typically used for this purpose. The switching contacts 21, 22 can be separated by the effect of electromagnetic repulsion forces when a current i flowing through the switching contacts 21, 22 exceeds a specific threshold value for current limiting. Furthermore, the switching device 1 has an overload and/or short-circuit detection element 40 in order to trip the switching mechanism 30.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

1 Switching device, power switching device, MCCB
2 Switching contacts
3 Switching shaft
4 Current path
5 Quenching chamber
5' Common quenching chamber
6 Splitter stack
7 Housing
8 Venturi nozzle
9 Gas outlet channel
10 Pressure sensor, pressure-dependent operating element
11 Cylinder
12 Piston
13 Spring element, cylindrical spring
14 Operating slide
15 Pressure connection line,
Reduced-pressure connection line,
Flexible connection tube, connection tube
16 Pressure connection line,
Overpressure connection line,
Flexible connection tube, connection tube
17 Connecting piece
18 Membrane, piston
20 Common shaft
21, 22 Switching contacts
25 Tripping mechanism
30 Switching mechanism
40 Overload and/or short-circuit detection element,
current transformer
52 Partition, separating wall
81 Constriction
82 Incident-flow aid
90 Gas outlet common channel, common tube
91 Measurement flow channel
92 Main flow channel
93 Reverse-flow flap
DW Pressure wave
F Force
i Current
LB Arc
P1, P2 Pressures

What is claimed is:

1. A switching device, comprising:

at least two switching contacts for interruption of a current path, with the at least two switching contacts being arranged in a quenching chamber to quench an arc which is struck on opening, the quenching chamber opening into a gas outlet channel for overpressure, produced during the striking of the arc, to escape therefrom; and a pressure sensor provided in the gas outlet channel for pressure detection, the pressure sensor being useable to trip a switching mechanism, connected at least indirectly to the pressure sensor, of the switching device upon reaching a target pressure value, the gas outlet channel including a Venturi nozzle and a reduced pressure, created in the Venturi nozzle as the gas flow passes through, being detectable via the pressure sensor.

2. The switching device as claimed in claim 1, wherein the gas outlet channel is in the form of a tube or shaft, and wherein the gas outlet channel includes a constriction to produce the reduced pressure.

3. The switching device as claimed in claim 1, wherein the pressure sensor is connected to the Venturi nozzle via a pressure connection line to detect the reduced pressure.

4. The switching device as claimed in claim 3, wherein the pressure connection line includes a connecting piece for connection to the Venturi nozzle, and wherein the connecting piece includes a pressure equalizing element for at least virtually gas-tight connection of the Venturi nozzle to the pressure sensor.

5. The switching device as claimed in claim 1, wherein an incident-flow element is arranged in the gas outlet channel and divides the gas outlet channel into a measurement flow channel and a main flow channel, and wherein the measurement flow channel is provided for pressure detection by way of the pressure sensor.

6. The switching device as claimed in claim 1, wherein the pressure sensor is in the form of an at least approximately gas-tight unit, and wherein the pressure sensor includes a cylinder and a piston, arranged such that the piston can move in the cylinder and includes an operating slide to trip the switching mechanism.

7. The switching device as claimed in claim 6, wherein the pressure sensor is connected as a pressure-dependent operating element to a tripping mechanism to trip the switching mechanism.

8. The switching device as claimed in claim 1, wherein the switching device includes a plurality of poles, wherein one quenching chamber, one gas outlet channel and one pressure sensor are provided for each pole, and wherein the respective pressure sensor is connected to a tripping mechanism to trip the switching mechanism.

9. The switching device as claimed in claim 8, wherein the respective pressure sensors are connected to a joint common shaft of the tripping mechanism.

10. The switching device as claimed in claim 1, wherein the switching device includes a plurality of poles, wherein one quenching chamber and one gas outlet channel are provided for each pole, wherein the respective gas outlet channels open into a joint gas outlet common channel and wherein the pressure sensor is connected to the gas outlet common channel for pressure detection, and is connected to a tripping mechanism to trip the switching mechanism.

11. The switching device as claimed in claim 10, wherein the gas outlet channels are each connected to the joint gas outlet common channel via a reverse-flow flap.

12. The switching device as claimed in claim 1, wherein the switching device includes a plurality of poles, wherein all the switching contacts are arranged in a common quenching chamber, wherein the respective switching contacts of one pole are electrically isolated from one another, wherein the common quenching chamber opens into the gas outlet channel, and wherein the pressure sensor is connected to a tripping mechanism to trip the switching mechanism.

13. The switching device as claimed in claim 1, wherein the switching device includes at least two switching contacts which are pressed against one another in a sprung manner when the switching device is in the connected position, for each pole, wherein the switching contacts are separateable by an effect of electromagnetic repulsion forces when a current which is flowing through the switching contacts exceeds a specific threshold value for current limiting, and wherein the switching device includes at least one of an overload and short-circuit detection element to trip the switching mechanism.

14. The switching device as claimed in claim 1, wherein the switching device is a power switching device.

15. The switching device as claimed in claim 2, wherein the pressure sensor is connected to the Venturi nozzle via a pressure connection line to detect the reduced pressure.

16. The switching device as claimed in claim 4, wherein the pressure equalizing element is a membrane or a piston.

* * * * *